United States Patent [19]

Austin, Jr. et al.

[11] Patent Number: 4,883,316

[45] Date of Patent: Nov. 28, 1989

[54] DENTAL INSTRUMENT DELIVERY SYSTEM

[75] Inventors: George K. Austin, Jr., Newberg; Mathew H. Parlier, Sheridan, both of Oreg.

[73] Assignee: A-Dec, Inc., Newberg, Oreg.

[21] Appl. No.: 245,675

[22] Filed: Sep. 20, 1988

Related U.S. Application Data

[63] Continuation-in-part of Ser. No. 101,797, Sep. 28, 1987, abandoned.

[51] Int. Cl.[4] ..... A47C 7/62

[52] U.S. Cl. ..... 297/191; 248/280.1; 297/188; 403/117

[58] Field of Search ..... 297/146, 163, 164, 188, 297/191, 411, 417; 248/280.1, 281.1, 289.1; 403/113, 117

[56] References Cited

U.S. PATENT DOCUMENTS

| | | | |
|---|---|---|---|
| 513,735 | 1/1894 | Russell | 297/188 X |
| 1,929,471 | 10/1933 | Bank | 297/304 |
| 3,489,384 | 1/1970 | Perbal | 248/280.1 |
| 3,813,147 | 5/1974 | Rick | 297/191 |
| 4,351,562 | 9/1982 | Twitchell et al. | 297/411 X |
| 4,630,862 | 12/1986 | Watanabe | 297/167 |

*Primary Examiner*—Peter R. Brown

*Attorney, Agent, or Firm*—Klarquist, Sparkman, Campbell, Leigh & Whinston

[57] ABSTRACT

A dental instrument delivery system is provided which includes an articulated retaining arm adjustable in a plurality of directions. The arm is connected to a cable mechanism in the back rest of a dental chair which allows the instruments carried by the arm to remain in a desired position when the back rest is tilted. Also included is a safety release system which prevents damage to the arm and instruments it carries should they accidentally engage a solid object when the chair and/or back rest is raised or lowered. After disengagement of the solid object, the arm automatically returns to its original position.

25 Claims, 3 Drawing Sheets

DENTAL INSTRUMENT DELIVERY SYSTEM

This is a continuation-in-part application of copending application Ser. No. 101,797 filed Sept. 28, 1987, now abandoned, entitled Dental Instrument Delivery System.

The present invention generally relates to an apparatus mounted to a dental chair for holding dental instruments, and more particularly to such an apparatus capable of maintaining the instruments in a desired position during adjustment of the chair. Also included is a safety release feature designed to prevent damage to the apparatus and instruments if they accidentally engage a stationary object during adjustment of the chair.

BACKGROUND OF THE INVENTION

In the practice of dentistry, it is important for the dental professional to have all of the necessary instruments in a convenient and accessible position. To facilitate access to the instruments, it is desirable that they be mounted directly on the dental chair. However, most chairs have electrical elevation systems and back rests designed to tilt upward or downward. It is therefore difficult to mount the instruments to chairs having these features.

Various systems have been designed to hold dental trays on a chair back in a desired position when the back is tilted. U.S. Pat. No. 3,813,147 to Rick and U.S. Pat. No. 4,630,862 to Watanabe disclose systems having this capability. The Rick patent involves an instrument tray in which the tray is attached to the back rest of the chair so that the tray moves upward when the back rest is lowered. The tray includes a support unit having a parallelogram linkage mechanism which maintains the tray horizontally oriented as the back rest is moved between an upright and reclining position. U.S. Pat. No. 4,630,862 to Watanabe discloses a dental chair which also includes an implement table maintained in a level position as the back rest is tilted. A complex system of linkage arms is used, which enables the elevation of the tray to be controlled.

To be effective, a dental instrument delivery system attached to the tiltable back rest of a chair must be capable of maintaining the instruments in a desired position while avoiding the use of complicated linkage systems. Since the chair in a dental office is the most frequently used piece of equipment, reliability is an important consideration.

Furthermore, it is important that the system be designed so that engagement of the system with a stationary object during adjustment of the chair will not result in damage to the instruments it carries. This problem is especially common when modern chairs are used which incorporate electrical means to rapidly raise and lower the chair.

The present invention involves an instrument delivery system which accomplishes the above objectives in a simple and reliable manner. Furthermore, it includes a safety release mechanism which prevents damage to the delivery system and instruments when such items accidentally engage a stationary object during raising and lowering of the chair.

SUMMARY OF THE INVENTION

It is an object of the invention to provide a chair-mounted dental instrument delivery system which allows ready and convenient access to the instruments during a dental procedure.

It is another object of the invention to provide a chair-mounted dental instrument delivery system which is simple in construction and design.

It is another object of the invention to provide a chair-mounted dental instrument delivery system which uses a minimal number of working components, and avoids the use of complex mechanical linkages.

It is a further object of the invention to provide a chair-mounted dental instrument delivery system which is adjustable in multiple directions, thereby allowing the instruments to be placed at a position of maximum convenience and accessbility.

It is a still further object of the invention to provide a chair-mounted dental instrument delivery system which maintains the instruments on a dental chair in a desired position when the back rest of the chair is tilted.

It is another object of the invention to provide a chair-mouted dental instrument delivery system which includes a safety release mechanism allowing the system to move upward or downward relative to the chair should it accidentally engage a solid object when the dental chair is lowered or raised.

To accomplish these and other objects, a dental instrument delivery system mounted to the rear of a dental chair is provided which includes an articulated instrument retaining arm adjustable in a plurality of directions and positions. This capacity enables the dental instruments held by the system to be readily available at all times. The arm is connected to a mechanism within the back rest of a dental chair which allows the instruments held by the arm to remain in the same plane as the back rest is tilted. This prevents the instruments from tilting during adjustment of the back rest. The mechanism uses a single control cable and eliminates the need for complex mechanical linkages. Included within the mechanism is a safety release system which enables the retaining arm to move upward relative to the back rest of the chair should it accidentally engage a solid object when the back rest is lowered. Likewise, the safety release system enables the retaining arm to move downward relative to the chair back rest should it engage a solid object when the back rest is raised. All of these features cooperate to produce a dental instrument delivery system of superior efficiency and design.

Further objects, features and advantages of the invention will be described in the following drawings and detailed description of a preferred embodiment.

DETAILED DESCRIPTION OF PREFERRED EMBODIMENT

Figure 1:
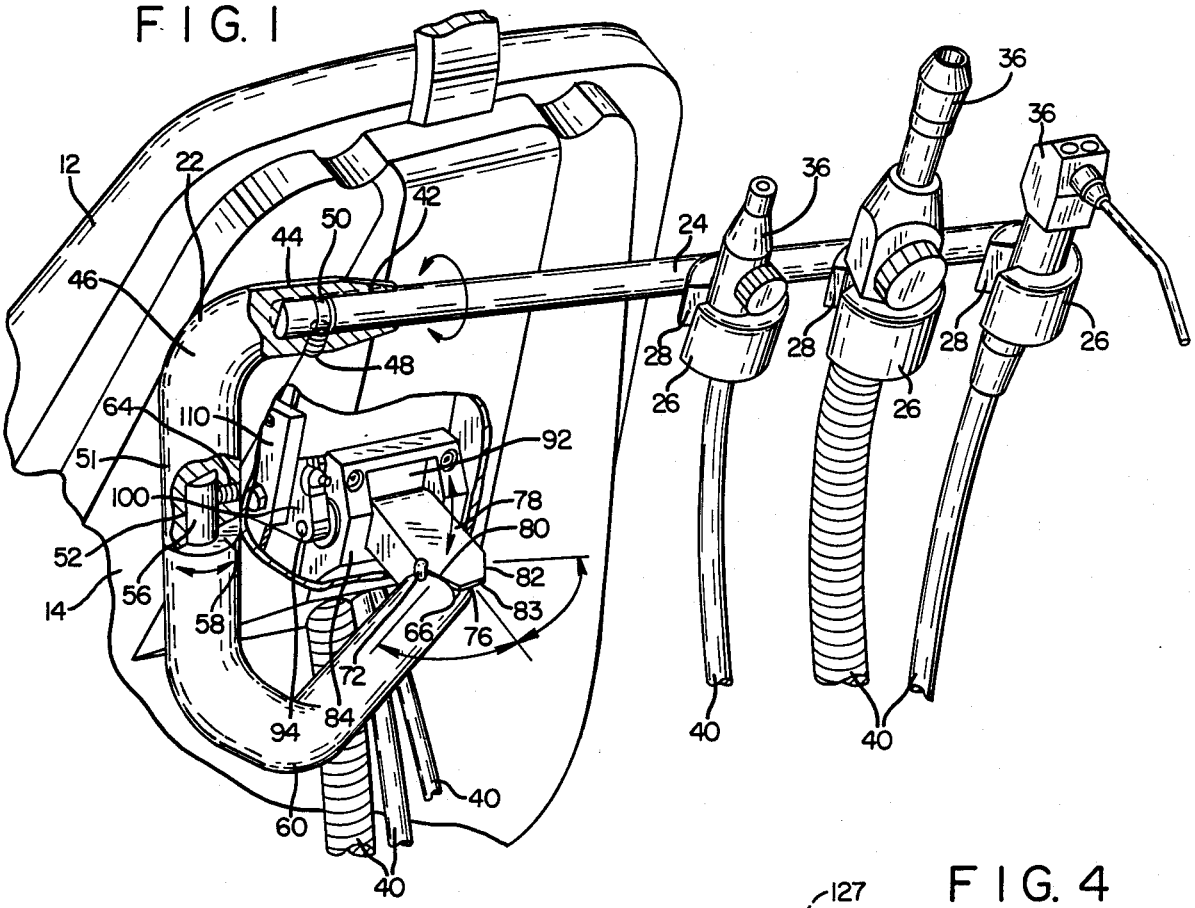
FIG. 1 is a perspective view of the instrument retaining arm and supporting mechanism of the invention attached to a dental chair having portions cut away to illustrate the construction of the arm.

With reference to FIG. 1, the invention is generally illustrated in association with a chair 12 of conventional design. The chair 12 includes a back rest 14 which may be tilted either manually or by motor drive in a continuous range of motion from a vertical to horizontal position.

The instrument delivery system of the invention basically consists of two main components. The first component comprises an instrument retaining means comprising an articulated arm 22 made of a strong, light material (preferably brushed aluminum). As illustrated in FIG. 1, the arm 22 includes an elongate horizontally extending end portion 24 to which a selected plurality of semi-circular instrument retaining members 26 are secured by screws or other conventional fasteners. Although three retaining members 26 are shown in the illustrated embodiment, the number may vary as desired. The retaining members 26 each have an open region 28 sized for insertion of a selected dental instrument 36. Such dental instruments may include syringes, and vacuum-operated suction devices. Connected to each dental instrument 36 is a supply line 40 which communicates with a suitable vacuum or water source.

The end portion 24 of the arm 22 is rotatably mounted within an opening 42 in the end of a horizontal portion 44 of a right-angled medial section 46. The end portion 24 is maintained in position within the opening 42 of the medial section 46 by an adjusting screw 48. The screw 48 extends into a groove 50 (FIG. 1) to prevent the accidental removal of the end portion 24 from the medial section 46.

The medial section 46 includes a downwardly extending portion 51 having an axial opening 52 adapted to receive a pin 56 at the end 58 of a connecting section 60. The medial section 46 is rotatable relative to the connecting section 60 about pin 56. The ease of rotation between these two components is controlled by the frictional engagement of a screw 64 in the medial section 46 adapted to engage the surface of pin 56 at a selected pressure.

Figure 3:
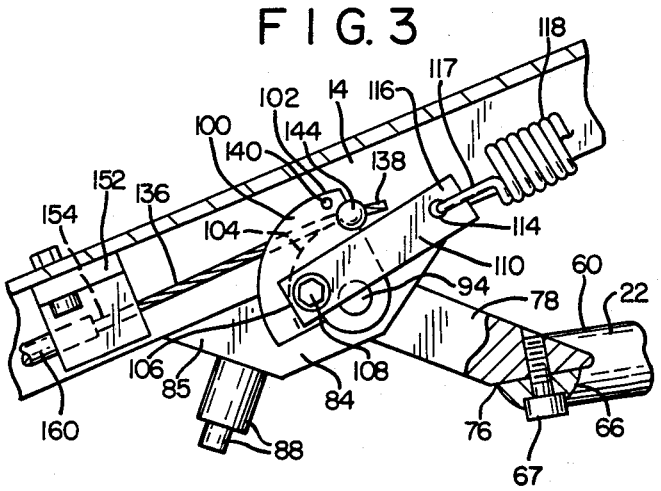
FIG. 3 is a fragmentary side view, partly in section, of a dental chair back rest and the mechanism used to corrdinate movement of the retaining arm with the back rest.
Figure 4:
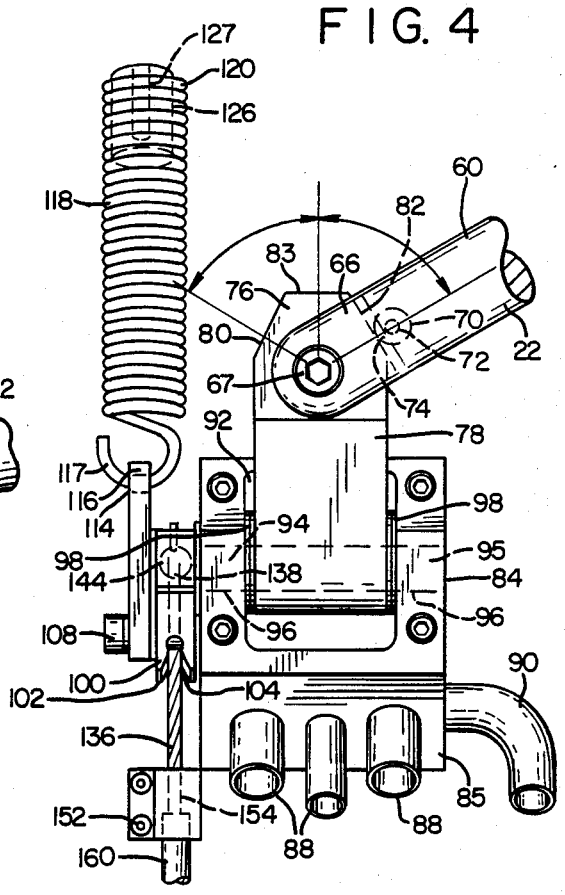
FIG. 4 is a fragmentary view from below of the apparatus used to mount the retaining arm to the back rest with the back rest not shown.
Figure 2:
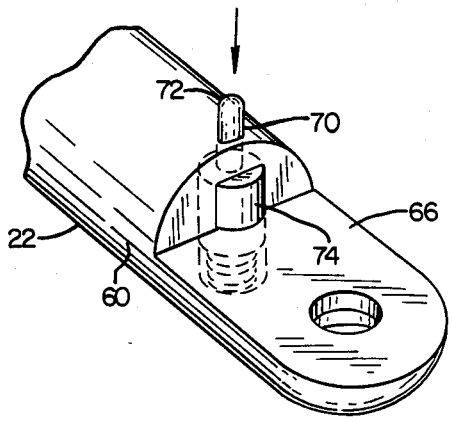
FIG. 2 is an enlarged perspective view of the flattened end of the retaining arm, and the spring-biased control mechanism associated therewith.

The connecting section 60 is also bent in a right angle as shown in FIG. 1, with the end opposite end 58 terminating in a flattened portion 66 (FIGS. 1 and 2). The flattened portion 66 of the connecting section 60 is rotatably secured by a vertically oriented screw 67 or other conventional fastener to the angled, horizontally extending surface 76 of an elongate attachment member 78 (FIGS. 3 and 4). This construction enables the arm 22 to be rotated about a vertical axis regardless of the position of the back rest 14.

The attachment member 78 further includes beveled edges 80, 82 and a medial edge 83 which cooperate with a spring biased control mechanism 70 in the connecting section 60. The control mechanism 70 enables arm 22 to be fixed in position either directly behind the chair 12 or on either side of the chair 12.

The control mechanism 70 includes a button 72, and a retractable stop member 74. When the stop member 74 is in an operative position, it will abut one of the edges 80, 82 or 83 (depending on where the arm 22 is positioned) and will secure the arm 22 in the selected position. FIG. 4 shows the stop member 74 in abutting engagement with edge 80. However, if movement to another position is desired, the button 72 is depressed, causing retraction of the stop member 74 within the arm 22 against a spring (not shown) mounted therein. This allows the arm 22 to be rotated to a position directly behind the back rest 14 or on either side of the chair 12.

The second major component of the invention consists of control means to coordinate movement of the arm 22 with the tilting movement of back rest 14. Secured within the back rest 14 of the chair 12 is a support block 84 as illustrated in FIGS. 3 and 4. The bottom portion 85 of the support block 84 includes a plurality of vacuum line connectors 88 communicating with a main vacuum pipe 90 on the side of the support block 84. Pipe 90 is connected to a conventional vacuum source known in the art. The connectors 88 are designed for the attachment of supply lines 40 which lead to the dental instruments 36 as described above.

Affixed to and extending from opposite sides of the attachment member 78 are pins 94, 95 pivotally mounted within the central portion 92 of the support block 84 as illustrated in FIGS. 3 and 4. The pins 94, 95 pivot in openings 96 on each side of the support block 84 (FIG. 4). Plastic bushings 98 line the openings 96.

As illustrated in FIG. 3, pin 94 of the attachment member 78 is fixedly secured to an upper guide member or crank arm 100. The guide member 100 has a curved peripheral edge 102 having a groove 104 therein coaxial with the axis of pins 94, 95. Since the pin 94 of the attachment member 78 is fixedly secured to the guide member 100, pivotal movement of the guide member 100 produces corresponding movement of the attachment member 78, as will be further described below.

Figure 5:
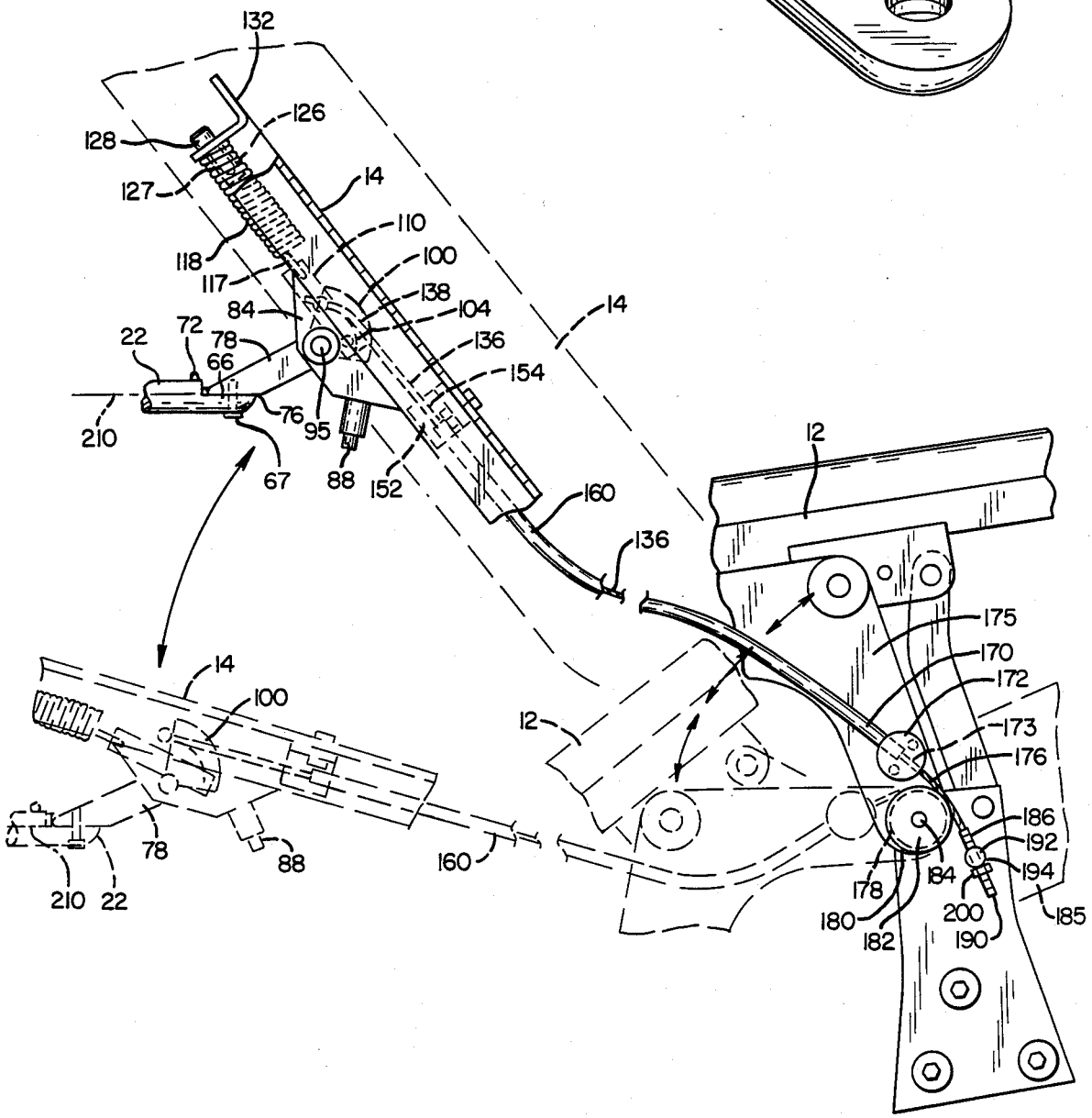
FIG. 5 is a fragmentary side view partly in section of a dental chair and the mounting mechanism for the instrument retaining arm, the solid lines illustrating the position of the mechanism when the back rest is in an upright position, with the dashed lines illustrating the mechanism after the back rest has been tilted downward.

Pivotally attached at position 106 on the guide member 100 using a fastener 108 is one end of a connecting bar 110 (FIG. 3). The fastener 108 passes through an opening (not shown) in the bar 110. Inserted through an opening 114 at the opposite end 116 of the bar 110 is the end 117 of a coil spring 118. Into the opposite end 120 of the spring 118, as shown in FIG. 4, an externally threaded plug 126 is positioned. The plug 126 has a threaded opening 127 in the end thereof for receiving a mounting screw 128 extending through a bracket 132 fixed to the back rest 14 (FIG. 5). This construction enables the spring 118 to be easily mounted and removed as desired, without exerting excessive contractive or expansive force on the spring. The function of spring 118 will be more fully explained hereinafter.

Positioned within the groove 104 of the upper guide member 100 is a cable 136 shown in FIGS. 3 and 4. The upper first end 138 of the cable 136 is positioned beneath a retaining screw 140 extending transversely through the guide member 100 and above the groove 104 as illustrated in FIG. 3. A spherical locking member 144 known in the art is attached to the end 138 of the cable 136 to prevent the end 138 from passing under the screw 140 and out of the groove 104. This arrangement insures that the cable 136 is always maintained in a proper position within the groove 104.

The cable 136 passes downwardly along the back rest 14 through an intermediate guide member 152 having a bore 154 sized to allow free movement of the cable 136 therethrough. As shown in FIGS. 3 and 4, beneath the guide member 152, the cable 136 extends through a tubular outer sheath 160 fixed to the guide member 152.

With reference to FIG. 5, the lower end 170 of the sheath 160 is fixedly secured to a cylindrical stop member 172. The stop member 172 includes a bore 173 sized to retain the sheath 160 therein, while allowing free passage of the lower, second end 176 of the cable 136 therethrough. The stop member 172 is suitably attached to the lower frame 175 of the back rest 14 of the chair 12.

The second end 176 of the cable 136 is positioned within a groove 178 in the peripheral edge 180 of a disc-shaped lower guide member 182. The guide member 182 is suitably secured to the chair 12 coaxially with the pivot axis 184 between the back rest 14 and the seat 185. Also, the guide member 182 has the same radius as that of the guide member 100.

With continued reference to FIG. 5, the second end 176 of the cable 136 further includes a cylindrical sleeve 186 permanently secured thereto. The sleeve 186 has a threaded portion 190 which extends through an opening 192 in a stud 194 fixedly secured to the chair 12 adjacent the guide member 182. The opening 192 is sized to allow free passage of the sleeve 186 therethrough. A nut 200 is threaded onto the threaded portion 190 beneath the stud 194.

Figure 6:
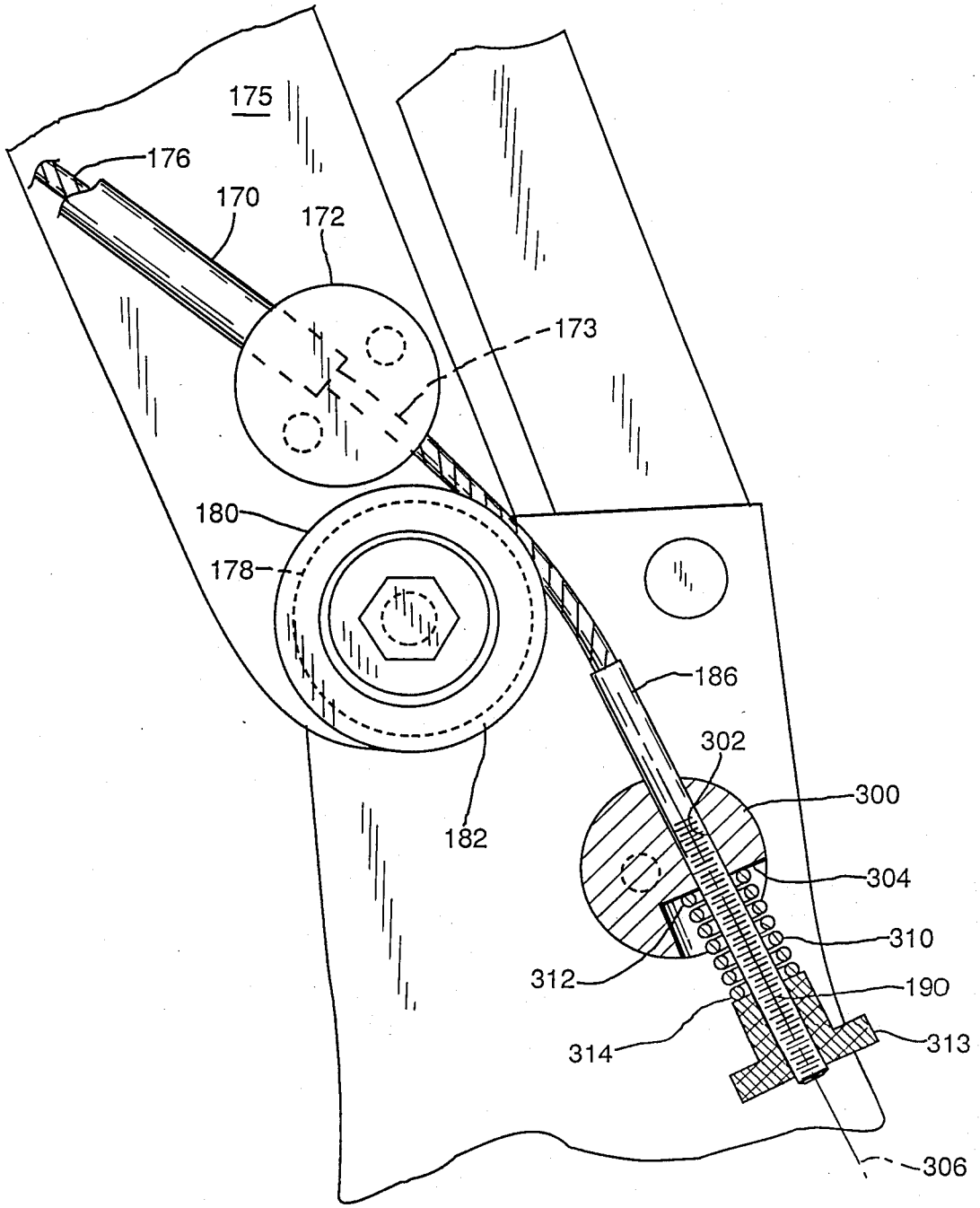
FIG. 6 is a fragmentary side view of an additional embodiment of the dental instrument delivery system showing the mechanism used to prevent damage to the retaining arm should it accidentally engage a stationary object during upward movement of the back rest.

FIG. 6 shows another embodiment of the invention which incorporates a system for preventing damage to the arm 22 and instruments it carries should the arm 22 engage a solid object during upward movement of the back rest 14. Upward movement of the back rest 14 typically occurs by either tilting of the back rest 14 to adjust its angular position or by moving the entire chair 12 upward. Specifically, an enlarged stud 300 is provided having an opening 302 therethrough. The stud 300 is fixedly secured to the chair 12 adjacent the guide member 182. Adjacent the opening 302 is a substantially flat face 304 which is preferably perpendicular to the longitudinal axis 306 of the opening 302. The opening 302 is sized to freely and movably receive the sleeve 186 therethrough. After passage of the sleeve 186 through the opening 302, a spring 310 having a diameter greater than that of the sleeve 186 is placed over the threaded portion 190 of the sleeve 186. The front 312 of the spring 310 is designed to engage the face 304 of stud 300. A nut 313 is then threaded onto the threaded portion 190 of the sleeve 186, engaging the rear 314 of the spring 310.

OPERATION

Operation of the instrument delivery system of the invention is illustrated in FIG. 5. The portions of FIG. 5 in solid lines show the system in a semi-upright position on the back rest 14, with the dashed lines showing the system after the back rest 14 is tilted downward.

When the back rest 14 is tilted downward, the arm 22 correspondingly rotates relative to the back rest 14 so that the arm 22 remains horizontal, and the instruments 36 held by the arm 22 remain in the same relative position. If the instruments 36 are in a substantially vertical orientation as shown in FIG. 1, they will remain in such orientation when the back rest 14 is tilted downward. This enables the instruments to be readily accessible at all times in the orientation desired by the dentist.

As the back rest 14 tilts, the second end 176 of cable 136 between the stud 194 and stop member 172 bends over and around the lower guide member 182 within the groove 178 (see dashed lines in FIG. 5). Since the nut 200 on the second end 176 of cable 136 engages the stud 194, tension is generated in the cable 136 which is transmitted to the first end 138 of the cable 136 to rotate the guide member 100 against the action of the spring 118 to which it is connected.

As the back rest 14 tilts and upper guide member 100 rotates, the attachment member 78 remains in the same angular position relative to the floor. However, the attachment member 78 tilts relative to the back rest 14 so as to cause arm 22 to remain horizontal and the instruments thereon to remain in a desired position. This result is shown in FIG. 5 by the position of attachment member 78 relative to horizontal plane 210. Such position remains the same both before and after movement of the back rest 14 as illustrated in FIG. 5.

The system operates in a reverse manner from that described above when the chair back rest 14 is moved upward, and achieves the same ultimate result.

The cooperative action of the upper and lower guide members 100, 182 is important in maintaining the instruments on the arm 22 in their desired position. Since members 100, 182 have an identical radius, the cable 136 causes the rotation of upper guide member 100 in an amount equal to the movement of cable 136 around the lower guide member 182. As a result, the attachment member 78 and arm 22 remain in the same relative position regardless of the tilting of back rest 14.

In addition, should the arm 22 engage a solid object when the chair 12 is lowered as back rest 14 is tilted, the force exerted against the arm 22 will be transmitted to the attachment member 78 causing it to rotate relative to the back rest 14. As the attachment member 78 rotates, corresponding rotational movement is conveyed to the upper guide member 100 to which it is attached, causing the guide member 100 to rotate against the bias of spring 118. This enables the arm 22 to move when it strikes a solid object. The spring 118 thus acts as a safety release means. When the chair 12 or back rest 14 is raised to clear the arm 22 from the engaged object, the arm 22 will return to its original position through the pulling action of the spring 118 against the upper guide member 100 to which the attachment member 78 and arm 22 are secured.

Should the cable 136 ever become permanently stretched due to repeated use, the nut 200 on the second end 176 of cable 136 can be rotated inward along the sleeve 186, increasing the tension of the cable 136 as necessary.

In the embodiment of FIG. 6, the arm 22 is capable of movement in the same manner as the embodiment of FIGS. 1–5 should it strike a solid object when the chair 12 and/or back rest 14 is lowered. The embodiment of FIG. 6 also includes a safety release means for preventing damage to the arm 22 and the instruments which it carries should they engage a solid object when the chair 12 and/or back rest 14 are raised upward. Specifically, the force exerted against the arm 22 during engagement is transmitted to the attachment member 78 causing it to rotate relative to the back rest 14. This rotation is opposite in direction to the rotation which occurs when the arm 22 strikes a solid object as the chair 12/back rest 14 is lowered downward. As the attachment member 78 rotates, it pulls upward on the cable 136, sleeve 186, and nut 313. Since the sleeve 186 is designed to freely move within the opening 302 of the stud 300, the nut 313 is urged toward the stud 300, further compressing the spring 310 therebetween. The ability of the nut 313 to move inward toward the stud 300 enables the arm 22 to move when it strikes an object during upward movement of the chair 12/back rest 14. When the arm 22 clears the engaged object, it will return to its original position through the decompressive action of spring 310 against the nut 313.

It should also be noted that the nut 313 is threadably adjustable along the sleeve 186 in order to selectively increase or decrease the compression of spring 310 between nut 313 and stud 300. Decreasing the compression of spring 310 consequently decreases the resistance exerted by arm 22 against a solid object when engagement between the two occurs. An opposite effect occurs when the compression of spring 310 is increased. Furthermore, should cable 136 ever become permanently stretched due to repeated use, the nut 313 can be rotated inward along sleeve 186 in order to compensate for the increased length of the cable 136 due to stretching.

Having herein described a preferred embodiment of this invention, it is apparent that suitable modifications may be made by those skilled in the art within the scope of the present invention. The invention is therefore to be construed in accordance with the following claims.

What is claimed is:

1. A dental instrument delivery system for use with a dental chair having a seat and a back rest tiltable about a fixed horizontal axis, said system comprising:

retaining means pivotably attached to said back rest for movement about a second horizontal axis holding a plurality of dental instruments in an accessible position during a dental procedure;

control means connected between said retaining means and said seat for pivoting said retaining means relative to said back rest with the tilting of said back rest so as to maintain said retaining means in a predetermined relation with respect to the horizontal irrespective of the position of said back rest; and safety release means operatively connected between said control means and said back rest for enabling said retaining means to move upward relative to said back rest when said retaining means is accidentally lowered downward onto a stationary object, whereby said safety release means prevents damage to said retaining means.

2. The system of claim 1 wherein said retaining means comprises an arm having an end portion having at least one instrument-holding member mounted thereon, a first section connected to said end portion, and a second section connected to said first section and movably attached to said tiltable back rest of said chair for pivotal movement about a horizontal axis.

3. The system of claim 2 wherein said second section of said arm further comprises stop means for selectively limiting the pivotal movement of said arm second section relative to said back rest of said chair.

4. The system of claim 3 further comprising an elongate attachment member having first and second ends, said first end being pivotally attached to said back rest of said chair, and said second end being attached to said second section of said arm in a manner wherein said arm may be rotated relative to said back rest of said chair.

5. The system of claim 4 wherein said stop means comprises a retractable pin fitted within said second section of said arm, said pin normally engaging said attachment member so as to limit the rotation of said arm, and the retraction of said pin allowing the rotation of said arm on said attachment member.

6. The system of claim 1 wherein said control means comprises:

a linkage cable having first and second ends, said second end being operably connected to said chair seat; and a crank arm fixedly secured to said retaining means, said crank arm having an arcuate surface concentric with said second horizontal axis, a cable guide member fixed to said chair seat, said cable guide member having an arcuate surface concentric with said first horizontal axis and of the same radius as that of said crank arm surface, said linkage cable being trained over said crank arm and cable guide member surfaces, said first cable and being secured to said crank arm, whereby raising or lowering of said back rest by tilting about said first horizontal axis causes an equal and opposite tilting of said retaining means about said second horizontal axis whereby said retaining means will be maintained in the same relative position to the horizontal as said back rest is tilted.

7. The system of claim 6 wherein said safety release means comprises tensioning means operably connected to said crank arm to urge it in a direction such as to maintain tension on said cable whereby said retaining means may move upwardly relative to said back rest against the tension in said spring.

8. The system of claim 7 wherein said tensioning means comprises a coil spring having first and second ends, said first end being operably connected to said crank arm, and said second end being attached to said back rest of said chair.

9. The system of claim 8 further comprising a plug member threadably engaged within said second end of said spring, said plug member having an internally threaded portion, and a cooperatively threaded attachment member threaded into said portion, and means securing said plug member to said back rest of said chair.

10. The system of claim 6 further comprising compensator means operably connected between said cable and said seat for controlling changes in the length of said cable caused by repeated use and stretching thereof.

11. The system of claim 10 wherein said second end of said cable is secured within a sleeve member, said sleeve member and attached cable being inserted through a stud mounted to said chair having an opening therein sized to receive said sleeve member, said sleeve member having a threaded portion sized to receive a cooperatively threaded tension adjusting member, the tightening of said tension adjusting member against said stud causing the tension in said cable to be increased.

12. A dental instrument delivery system for use with a dental chair having a seat, a back rest tiltable about a fixed horizontal axis, and means for selectively raising and lowering said chair, said system comprising:

retaining means movably attached to said back rest for holding a plurality of dental instruments in an accessible position, said retaining means having an arm having a rotatable end portion comprising a plurality of instrument-holding members mounted thereon, a first section rotatably connected to said end portion, and a second section rotatably connected to said first section and movably attached to said tiltable back rest of said chair;

an elongate attachment member having first and second ends, said first end being pivotally attached to said back rest of said chair, and said second end being attached to said second section of said arm in a manner wherein said arm may be rotated relative to said back rest of said chair;

stop means for selectively limiting the movement of said arm relative to said back rest of said chair comprising a retractable pin fitted within said second section of said arm, said pin normally engaging said attachment member so as to limit the rotation of said arm, and the retraction of said pin allowing the rotation of said arm on said attachment member;

control means for coordinating the movement of said arm with the movement of said back rest comprising a linkage cable having first and second ends, said first end being operatively connected to said elongate attachment member, with said second end being operably connected to said chair at the bottom thereof, and first and second cooperative cable guide members, said first guide member being adapted to receive said first end of said cable and being fixedly secured to said elongate attachment member whereby movement of said first guide member causes corresponding movement of said attachment member, said second guide member being fixedly secured to the chair at the bottom thereof and adapted to receive said second end of said cable;

said first and second cable guide members each having a curved outer periphery, with the radius of said first guide member being identical to that of said second guide member, each of said first and second cable guide members further comprising a groove within said curved outer periphery, said groove being sized to receive said cable;

tensioning means for maintaining tension on said cable comprising a spring having first and second ends, said first end being operably connected to said first cable guide member, and said second end being attached to said back rest of said chair, said spring further comprising a plug member threadably engaged within said second end thereof, said plug member having an internally threaded portion receiving a cooperatively threaded attachment member for securing said plug member and said second end of said spring to said back rest of said chair;

compensator means for controlling changes in the length of said cable caused by repeated use and stretching thereof comprising a sleeve member fixedly attached to said second end of said cable, said sleeve member and attached cable being inserted through a stud mounted to said chair having an opening therein sized to receive said sleeve member, said sleeve member further comprising a threaded portion sized to receive a cooperatively threaded tension adjusting member, the tightening of said tension adjusting member against said stud causing the tension in said cable to be increased; and safety release means for enabling said arm to move upward relative to said back rest when said arm is accidentally lowered downward onto a stationary object, said safety release means comprising said spring used to maintain tension on said cable, said spring being operatively connected to said arm to allow the upward movement thereof.

13. A dental instrument delivery system for use with a dental chair having a seat and a back rest tiltable about a fixed horizontal axis, said system comprising:

retaining means movably attached to said back rest for holding a plurality of dental instruments in an accessible position during a dental procedure;

control means operably connected between said retaining means and said chair seat for effecting movement of said retaining means with the tilting of said back rest so that said retaining means is maintained in a predetermined desired relation relative to the floor as said back rest is tilted;

first safety release means operably connected between said control means and said back rest for enabling said retaining means to move upward relative to said back rest when said retaining means is accidentally lowered downward onto a stationary object, whereby said first safety release means prevents damage to said retaining means; and second safety release means operably connected to said control means for enabling said retaining means to move downward relative to said back rest when said retaining means is accidentally raised upward against a stationary object, whereby said second safety release means prevents damage to said retaining means.

14. The system of claim 13 wherein said retaining means comprises an arm having an end portion having at least one instrument-holding member mounted thereon, a first section connected to said end portion, and a second section connected to said first section and movably attached to said tiltable back rest of said chair.

15. The system of claim 14 further comprising an elongate attachment member having first and second ends, said first end being pivotally attached to said back rest of said chair, and said second end being attached to said second section of said arm in a manner wherein said arm may be rotated relative to said back rest of said chair.

16. The system of claim 15 further comprising a linkage cable having first and second ends, said first end being operably connected to said elongate attachment member, and said second end being operably connected secured to said chair at the bottom thereof.

17. The system of claim 16 wherein said control means comprises first and second cooperative cable guide members, said first guide member being adapted to receive said first end of said cable and fixedly secured to said elongate attachment member wherein movement of said first guide member causes corresponding movement of said attachment member, said second guide member being fixedly secured to said chair at the bottom thereof and adapted to receive said second end of said cable, said first and second guide members cooperating to allow said cable to coordinate the movement of said arm with the movement of said back rest.

18. The system of claim 17 wherein said first and second cable guide members each have a curved outer periphery, with the radius of said first guide member being identical to that of said second guide member, each of said first and second cable guide members further comprising a groove within said curved outer periphery, said groove being sized to receive said cable.

19. The system of claim 17 further comprising tensioning means operably connected between said cable and said chair for maintaining tension on said cable.

20. The system of claim 19 wherein said tensioning means comprises a spring having first and second ends, said first end being operably connected to said first cable guide member, and said second end being attached to said back rest of said chair.

21. The system of claim 20 further comprising a plug member threadably engageable within said second end of said spring, said plug member having an internally threaded portion sized to receive a cooperatively threaded attachment member for securing said plug member and said second end of said spring to said back rest of said chair.

22. The system of claim 16 wherein said second safety release means comprises:

a sleeve member secured to said second end of said cable having a threaded portion thereon;

a stud mounted to said chair having an opening therein sized to movably receive said sleeve member;

a tension adjusting member threadably engageable with said threaded portion of said sleeve member; and a biasing member positioned on said sleeve member between said stud and said tension adjusting member.

23. The system of claim 22 wherein said biasing member comprises a spring.

24. The system of claim 13 wherein said first safety release means comprises a spring operably connected between said chair back rest and said retaining means for allowing the upward movement of said retaining means.

25. A dental instrument delivery system for use with a dental chair having a seat and a back rest tiltable about a first horizontal axis, said system comprising:

retaining means for holding a plurality of dental instruments, attachment means securing said retaining means to said back rest for movement of said retaining means about a second horizontal axis, a crank arm having an arcuate surface concentric with said axis fixedly secured to said retaining means for rotation about said second horizontal axis, a cable guide member fixed to said chair, said guide member having an arcuate surface coaxial to said first horizontal axis and of the same radius as that of said crank arm surface, a linkage cable attached at one end to the free end of the crank arm and at its opposite end to said chair seat, and being trained over said crank arm surface and over said cable guide member surface, and spring means extending between said crank arm and said back rest urging said crank arm in a direction to maintain said linkage cable taut, whereby as said back rest is raised or lowered, said retaining means will be caused to pivot relative to the back rest so that the retaining means will maintain the same relative position with respect to the horizontal regardless of the position of the back rest except, that if during lowering movement of said back rest said retaining means should engage an object resisting downward movement of said retaining means, said spring means will permit pivoting of said retaining means relative to the back rest and against the bias of said spring means to obviate injury to said object or said retaining means.

* * * * *